United States Patent [19]

Hölss

[11] Patent Number: 4,893,985

[45] Date of Patent: Jan. 16, 1990

[54] MULTI-STAGE MOLECULAR PUMP

[75] Inventor: Kurt Hölss, Huettenberg, Fed. Rep. of Germany

[73] Assignee: Arthur Pfeiffer Vakuumtechnik Wetzlar GmbH, Asslar, Fed. Rep. of Germany

[21] Appl. No.: 232,499

[22] Filed: Aug. 15, 1988

[30] Foreign Application Priority Data

Aug. 24, 1987 [DE] Fed. Rep. of Germany ..... 3728154

[51] Int. Cl.[4] ..... F01D 1/36

[52] U.S. Cl. ..... 415/90

[58] Field of Search ..... 415/90, 143

[56] References Cited

U.S. PATENT DOCUMENTS

| | | | |
|---|---|---|---|
| 4,645,413 | 2/1987 | Reich | 415/90 |
| 4,668,160 | 5/1987 | Mase et al. | 415/90 |
| 4,684,317 | 8/1987 | Luijten et al. | 415/90 |
| 4,732,530 | 3/1988 | Ueda et al. | 415/90 |
| 4,746,265 | 5/1988 | Luijten | 415/90 |

FOREIGN PATENT DOCUMENTS

| | | | |
|---|---|---|---|
| 2409857 | 3/1977 | Fed. Rep. of Germany | 415/90 |
| 887499 | 11/1943 | France | 415/90 |

OTHER PUBLICATIONS

European Patent No. 129,709, Jan. 1985, Kaneto.
Turbomolecular Pump Becker, Oct. 1966.
Molecular Pump, Gaede, pp. 337–380.

*Primary Examiner*—Robert E. Garrett
*Assistant Examiner*—John T. Kwon
*Attorney, Agent, or Firm*—Toren, McGeady & Associates

[57] ABSTRACT

A molecular pump of the Hollweck type is composed of a plurality of stages in order to improve the pumping characteristics. Rotor and stator consist of different portions which are provided alternately with helical grooves and with smooth outer and inner surfaces respectively. The cooperating surfaces of the individual rotor and stator portions are tapered.

11 Claims, 3 Drawing Sheets

MULTI-STAGE MOLECULAR PUMP

Figure 1:
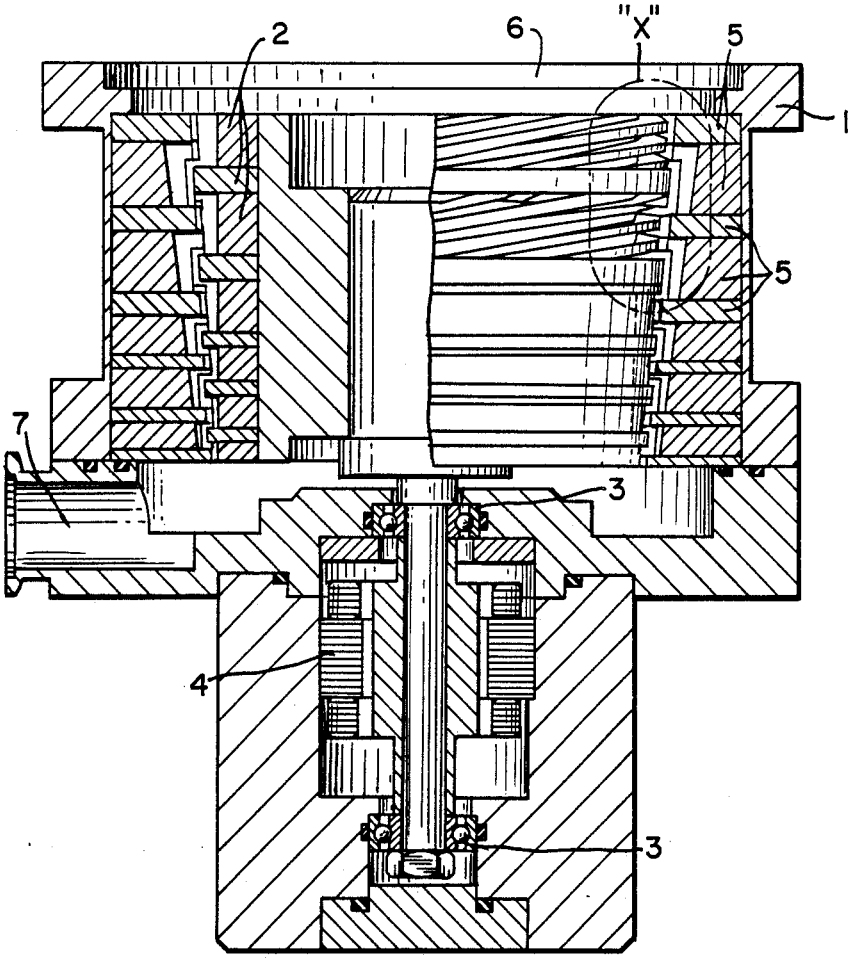

The invention relates to a molecular pump.

A molecular pump is a mechanical-displacement pump, the mode of operation of which is based on the principle of the transmission of impulses from moving walls to molecules. The basic principle was described by W. Gaede (Ann.d.Phys.(4) 41, 337 (1913)). Various forms are known. The present invention is based on the pump conceived by Hollweck (Comptes rendus 177,43 (1923)) and named after him. In this, there is a cylindrical rotor inside a cylindrical housing and either the outer surface of the rotor or the inner surface of the cylindrical housing or both are provided with helical grooves to transport and guide the gas.

Molecular pumps of the Hollweck type are used, for example, in connection with turbo-molecular pumps (W. Becker, Vakuumtechnik 9/10 (1966)). Their effective working range is restricted to the field of molecular flow, that is to say they only work together with a backing pump which pumps against atmospheric pressure. These are usually two-stage rotary vane pumps.

Because of the narrow gap between rotor and stator, the working range of a Hollweck molecular pump reaches up to much higher pressures than that of a turbo-molecular pump. By the combination of these two molecular pumps, the expense for the production of the backing pressure can be considerably reduced. It is a decisive advantage for use in certain processes, as in plasma etching for example, if the oil-sealed rotary vane pump can be replaced by a pump working dry, for example a diaphragm pump.

Molecular pumps of the Hollweck type have been proposed in various forms, in particular even in combination with turbo-molecular pumps (for example DE AS 24 09 857 and EP 01 29 709). Up to now, however, it has not been possible, in practice, to use these pumps over a wide field of applications. The reasons for this are essentially as follows: In molecular pumps with helical channels, a pressure ratio builds up continuously along the channels from the suction side to the discharge side, during operation. As a result of this pressure ratio, a back-streaming is caused which occurs from the discharge side towards the suction side via the gap between rotor and stator. As a result, the pressure ratio and the suction capacity are considerably reduced. In order to limit these losses, it is necessary to make the gaps between rotor and stator very small.

Gaps of the order of magnitude of a few hundredths of a millimetre are usual.

At the high speeds of rotation which are necessary for satisfactory efficiency, great technical problems arise which make the molecular pumps of the Hollweck type into extremely critical components. Since, for safety reasons, the gap between rotor and stator must be the greater, the higher the speed of rotation of the pump, the losses through backstreaming thus also become greater.

It is the object of the invention to develop a molecular pump wherein the above-mentioned disadvantages do not occur. In particular, the effect is to be achieved that the gaps between rotor and stator can be made so large that reliable operation is ensured while at the same time the backstreaming is reduced to a minimum.

Accordingly, the invention proposes a molecular pump for handling gases, consisting of rotor and stator which are disposed concentrically to one another, the rotor being inside the stator, characterised in that rotor and stator each consist of a plurality of portions which together form a plurality of pump stages and each pump stage is in turn composed of various pump sections.

The ratio K of the whole pump is composed of the pressure ratios of the individual pump stages $K_1$, $K_2$ . . . $K_n$ as follows: $K=K_1\times K_2\times \ldots \times K_n$.

The backstreaming from the discharge side to the suction side, which takes place between rotor and stator, increases with the pressure ratio of the pump. The division of the pump into a plurality of pump stages with a smaller pressure ratio causes a decisive reduction in the backstreaming.

Further decisive advantages can be achieved with a tapered shape of rotor and stator, and by the fact that the portions of the rotor with a smooth outer surface, which mark its outermost diameter, and the portions of the stator with a smooth inner surface, which mark its innermost diameter, have their outer and inner taper respectively on the same generated surface.

One feature which is important for the build-up of a maximum pressure ratio inside the pump is the optical tightness. This means that no rectilinear free communication exists between the individual pump stages as a result of which, the molecules have no possibility of passing unhindered from one pump stage into the next. Thus a further obstacle is opposed to the backstreaming which is already reduced by the division into individual pump stages.

As a result of the fact that the portions of the rotor with a smooth outer surface and the portions of the stator with a smooth inner surface lie on the same generated surface and do not project beyond it, that is to say rotor and stator portions do not interlock, the assembly of the pump is considerably facilitated. If the larger diameters of the tapers are at the suction side, the rotor can be removed upwards. In the reverse case, if the larger diameters of the tapers are at the discharge side, the stator can be removed upwards. In no case it is necessary to separate rotor or stator portions.

The fact that rotor and stator portions do not interlock leads to the advantage that in the event of axial expansion of rotor or stator, an axial collision is ruled out.

Since the gas is ever more compressed from pump stage to pump stage, beginning with the first at the suction side, the volume of the gas is correspondingly reduced while flowing through the pump. Thus the volumes needed for transport can be reduced. This leads to the fact that the depth and/or the width of the grooves as well as the axial extent of the individual pump units can decrease from the suction side towards the discharge side. It is likewise possible to reduce the pitch of the grooves towards the discharge side. A higher pressure ratio for these stages results from these measures.

An examplary embodiment is illustrated in the two drawings and described in more detail below.

Figure 2:
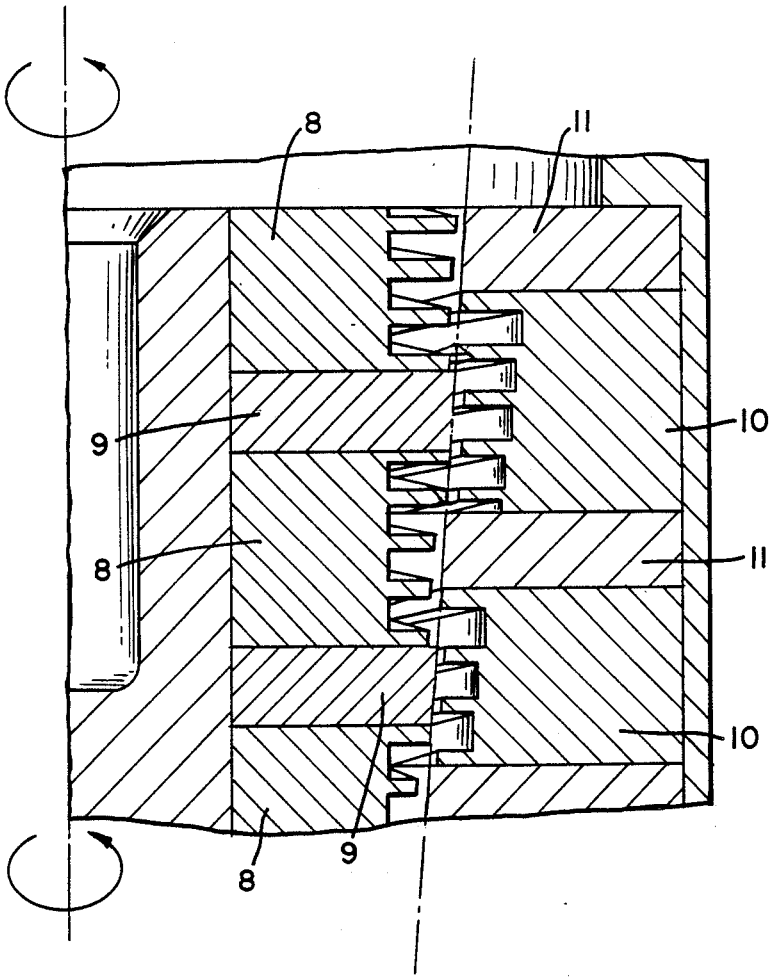
Figure 3:
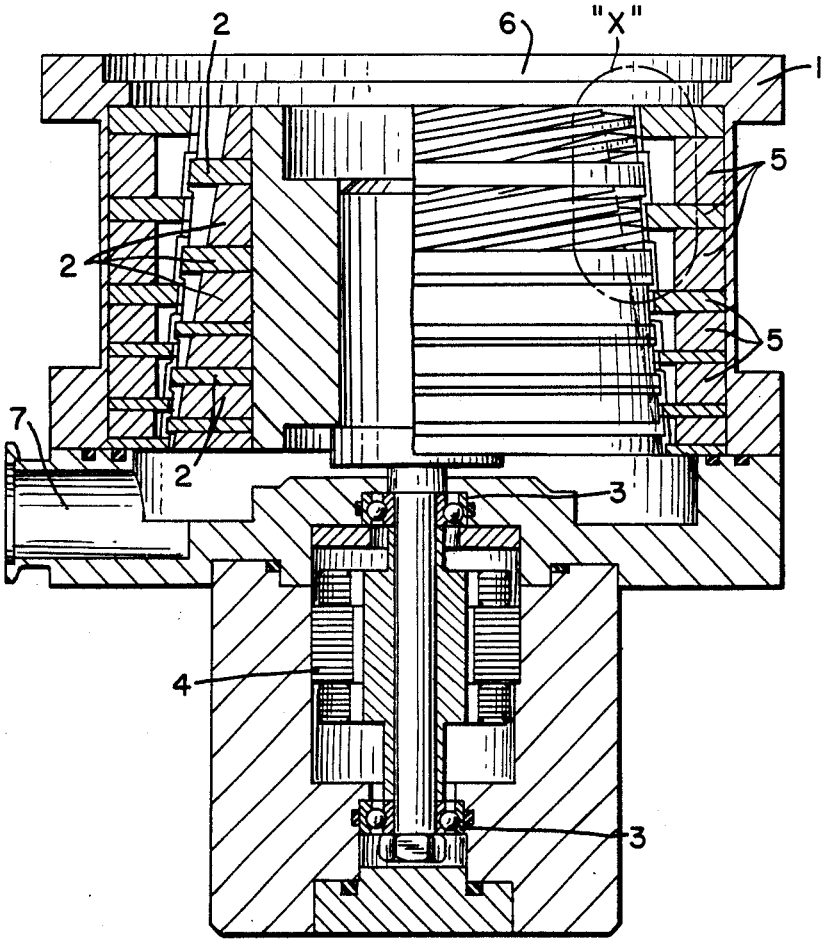

FIG. 1 shows a general illustration of the molecular pump according to the invention, FIG. 2 shows the detail "X" from FIG. 1, and FIG. 3 shows a detail of another embodiment of the invention.

As FIG. 1 shows, a rotor 2, which is located by a bearing arrangement 3 and driven by a motor 4, is in a housing 1. The rotor 2 is disposed inside a stator 5. Transport of the gas is effected from the suction side 6, via rotor and stator, to the discharge side 7.

In FIG. 2, rotor 2 and stator 5, which are each composed if a plurality of portions, are illustrated in more detail. The rotor consists of two kinds of portion with different surfaces which are arranged alternatively one behind the other. The one kind 8 has helical grooves at the outside diameter and the other kind 9 has a smooth surface. The stator likewise consists of two kinds of portion with different surfaces which are arranged alternately one behind the other, the one kind 10 having helical grooves at the internal diameter and the other kind 11 having a smooth surface.

The rotor and stator portions together form pump stages which are composed of pump sections as follows:

One pump section of a pump stage consists of a part of a poirtion 8 with helical grooves of the rotor and of a portion 11 with a smooth inner surface of the stator. Two pump sections each consists of a part of a portion 8 with helical grooves of the rotor and a part of a portion 10 with helical grooves of the stator. A further pump section consists of a portion 9 with a smooth outer surface of the rotor and of a part of a portion 10 with helical grooves of the stator.

This construction applies to the embodiment given. In other embodiments, the number and sequence of the pump sections of a pump stage might be different.

The individual portions of the rotor are made tapered at their outside and the individual portions of the stator are made tapered at their inside. The outer surfaces of the rotor parts 9 and the inner surfaces of the stator parts 11 lie on the same generated surface.

The axial extent of the individual pump sections decreases from the suction side towards the discharge side. However, as shown in FIG. 3, the axial extent of the individual pump sections may also decrease from the discharge side toward the suction side. The depth and/or the width of the helical grooves as well as their pitch decrease towards the discharge side.

I claim:

1. A molecular pump for handling gases comprising a rotor and a stator which are disposed concentrically to one another, the rotor being inside the stator, wherein rotor (2) and stator (5) each consist of a plurality of portions (8,9; 10,11) which together form a plurality of pump stages and each pump stage is in turn composed of various pump sections, wherein the rotor (2) consists alternately of portions (8) which are provided with helical grooves at the outside, and of portions (9) the outer surfaces of which are smooth.

2. A molecular pump according to claim 1, wherein the stator (5) consists alternately of portions (10) which are provided with helical grooves at the inside, and of portions (11) the inner surfaces of which are smooth.

3. A molecular pump according to claim 2, wherein the portions of the rotor with a smooth outer surface and the portions of the stator with a smooth inner surface lie with their external and internal tapers respectively on the same generated surface.

4. A molecular pump according to claim 2, wherein the depth of the helical grooves decreases from the suction side towards the discharge side.

5. A molecular pump according to claim 2, wherein the width of the helical grooves decreases from the suction side towards the discharge side.

6. A molecular pump according to claim 1, wherein one pump section of a pump stage is formed from part of a portion (8) of the rotor with helical grooves and from a portion (11) of the stator with a smooth inner surface, two pump sections each being formed from a part of a portion (8) of the rotor with helical grooves and from a part of a portion (10) of the stator with helical grooves, and one pump section being formed from a portion (9) of the rotor with a smooth outer surface and from a part of a portion (10) of the stator with helical grooves.

7. A molecular pump according to claim 1 wherein the individual portions of the rotor are tapered at their outside and the individual portions of the stator are tapered at their inside.

8. A molecular pump according to claim 7, wherein the larger diameters of the tapers are disposed towards the suction side.

9. A molecular pump according to claim 7, wherein the larger diameters of the tapers are disposed towards the discharge side.

10. A molecular pump according to claim 1, wherein the axial extent of the individual pump sections decreases from the suction suction side towards the discharge side of the pump.

11. A molecular pump according to claim 1, wherein the pitch of the helical grooves decreases from the suction side towards the discharge side.

* * * * *